US011724530B2

(12) United States Patent
Nakayama

(10) Patent No.: US 11,724,530 B2
(45) Date of Patent: Aug. 15, 2023

(54) PRINTING APPARATUS

(71) Applicant: SEIKO EPSON CORPORATION, Tokyo (JP)

(72) Inventor: Hiroyuki Nakayama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/455,934

(22) Filed: Nov. 22, 2021

(65) Prior Publication Data

US 2022/0161580 A1 May 26, 2022

(30) Foreign Application Priority Data

Nov. 24, 2020 (JP) ..... 2020-194181

(51) Int. Cl.
*B41J 29/13* (2006.01)
*B41J 29/02* (2006.01)

(52) U.S. Cl.
CPC ..... *B41J 29/13* (2013.01); *B41J 29/02* (2013.01)

(58) Field of Classification Search
None
See application file for complete search history.

(56) References Cited

U.S. PATENT DOCUMENTS 4,729,452 A * 3/1988 Sims ..... B41J 29/08 181/201
2003/0020797 A1* 1/2003 Takahashi ..... B41J 29/023 347/108

FOREIGN PATENT DOCUMENTS

JP 2016-215522 A 12/2016
JP 2020029098 A * 2/2020

OTHER PUBLICATIONS

Yu, Y, "Quick-changing Table-board for Automobile Wiring Harness Detecting Table, Has Upper Rack Whose Side Is Located on Quick Changing Box Switching Plate and Provided With Switching Plate Operating Port That Is Provided With Shielding Door" Aug. 14, 2020, China, (Year: 2020).*
Takehara, Kenichi, "Frame for Supporting Housing", Apr. 17, 2013, China (Year: 2013).*
Hug Klaus DIPL-ING, FH, "Casing for a Electronic Device", Jul. 27, 1994, Europe (Year: 1994).*

* cited by examiner

*Primary Examiner* — Erica S Lin
*Assistant Examiner* — Tracey M McMillion
(74) *Attorney, Agent, or Firm* — Workman Nydegger

(57) ABSTRACT

A printing apparatus includes a recording unit configured to record an image on a medium, a housing configured to accommodate the recording unit, and a cover provided at the housing and configured to be opened and closed, the cover being configured such that an interior thereof is visible, in which the cover includes a rectangular frame having two long side parts and two short side parts, and a light transmissive plate that is transmissive and attached to the frame, and each of the long side parts is a hollow structure with a metal material.

6 Claims, 7 Drawing Sheets

PRINTING APPARATUS

The present application is based on, and claims priority from JP Application Serial Number 2020-194181, filed Nov. 24, 2020, the disclosure of which is hereby incorporated by reference herein in its entirety.

BACKGROUND

1. Technical Field

The disclosure relates to a printing apparatus.

2. Related Art

Conventionally, as illustrated in JP-A-2016-215522, an image forming device is known that provides an image forming unit forming an image on a medium inside a device main body. A cover that can be opened and closed to view inside the device main body is provided to the device main body of the image forming device.

The cover of the image forming device is configured by, for example, framing four corners of a plastic plate that is transmissive with sheet metal. Such a case poses an issue of the sheet metal being heavy, which increases the weight of the cover, and the cover cannot be opened and closed smoothly. On the other hand, with a configuration framing the plastic plate with plastic, although the weight is reduced, rigidity is low and torsion may arise in the cover, and the cover again cannot be opened and closed smoothly.

SUMMARY

A printing apparatus includes a recording unit configured to record an image on a medium, a housing configured to accommodate the recording unit, and a cover provided at the housing and configured to be opened and closed, the cover being configured such that an interior thereof is visible, in which the cover includes a rectangular frame having two long side parts and two short side parts, and a light transmissive plate that is transmissive and attached to the frame, and each of the long side parts is a hollow structure with a metal material.

DESCRIPTION OF EXEMPLARY EMBODIMENTS

A configuration of a printing apparatus 10 will be described. The printing apparatus 10 is an inkjet printer capable of printing on a comparatively large medium M (for example, sheet size A0).

Figure 1:
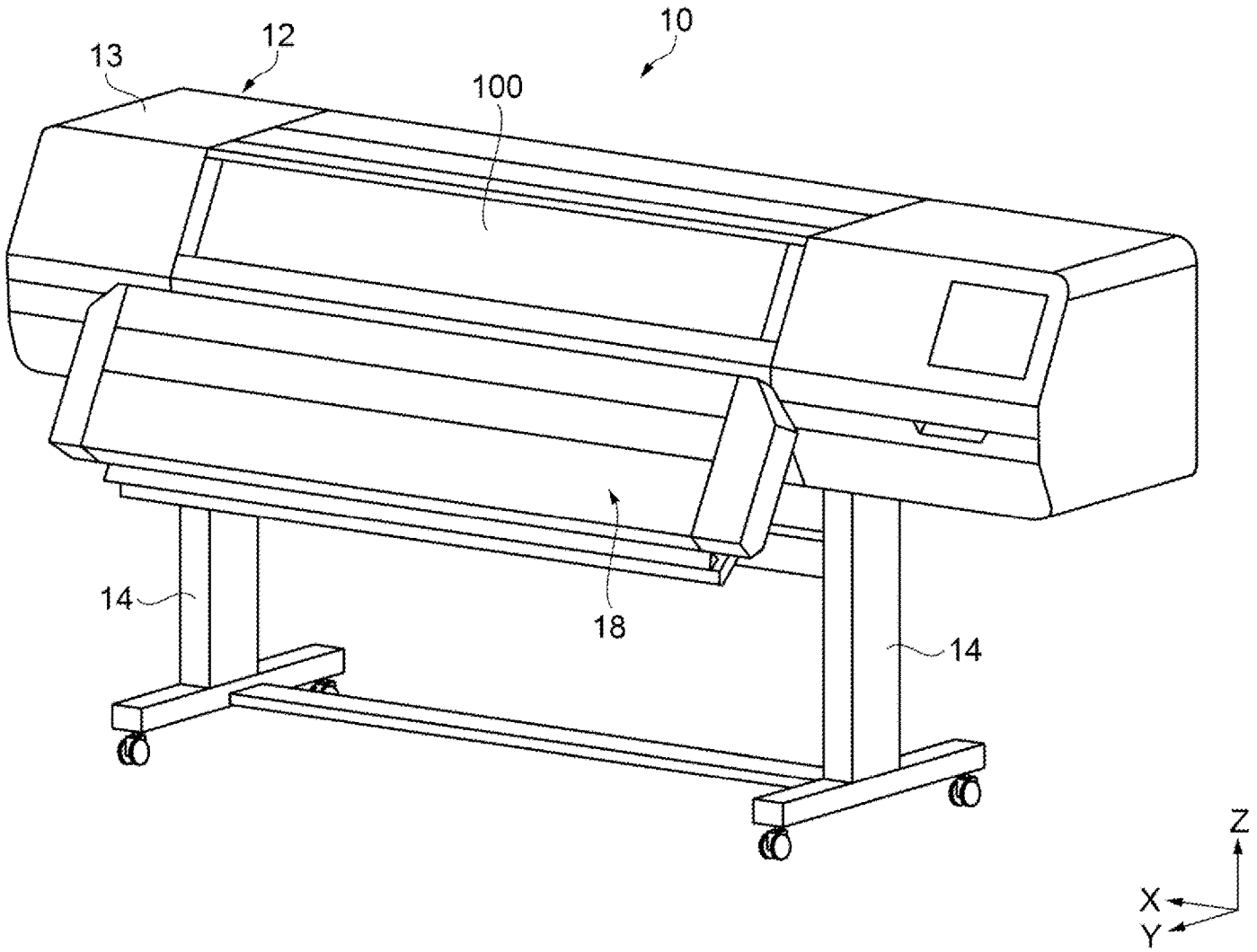
FIG. 1 is a perspective view illustrating a configuration of a printing apparatus.
Figure 2:
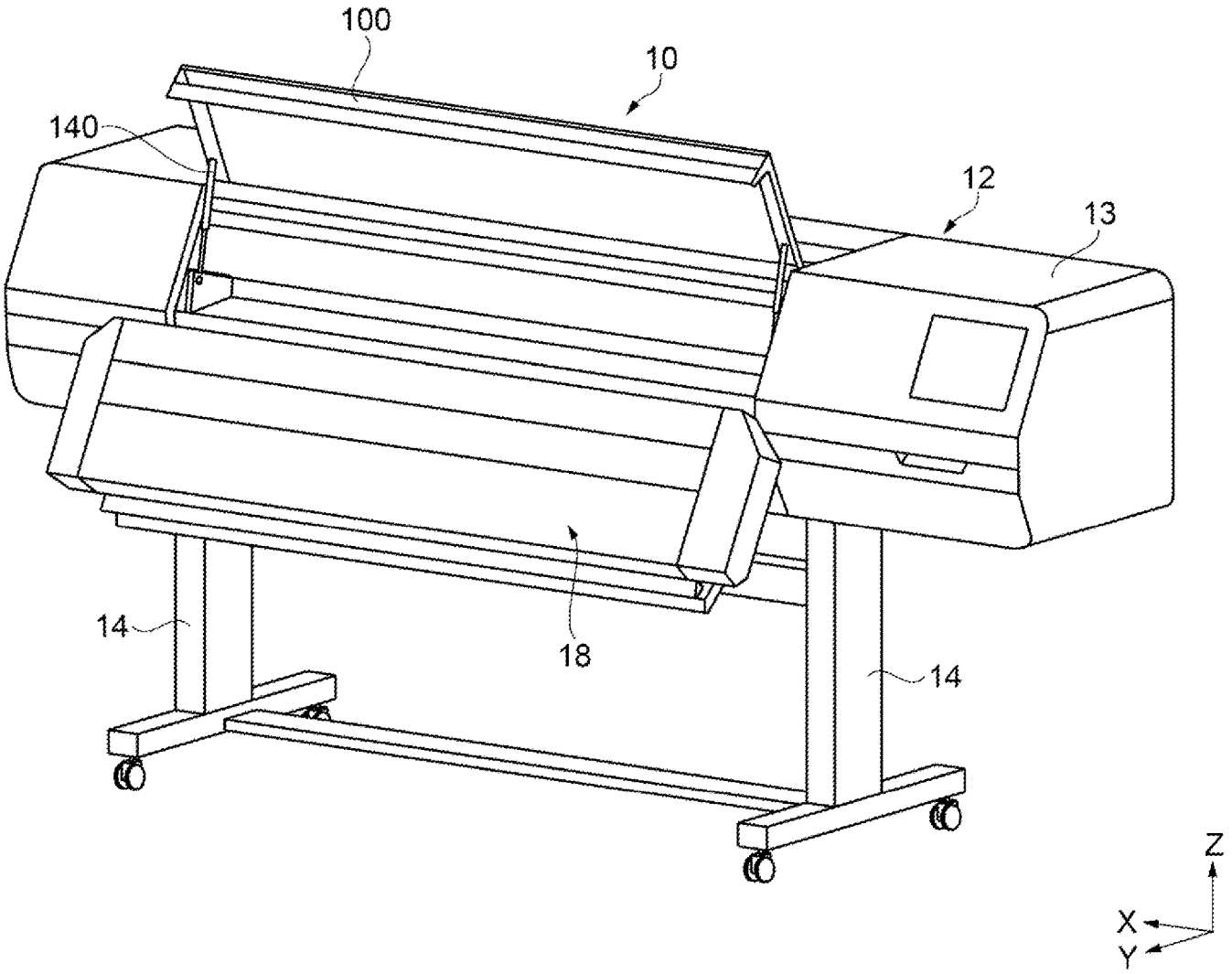
FIG. 2 is a perspective view illustrating a configuration of the printing apparatus.
Figure 3:
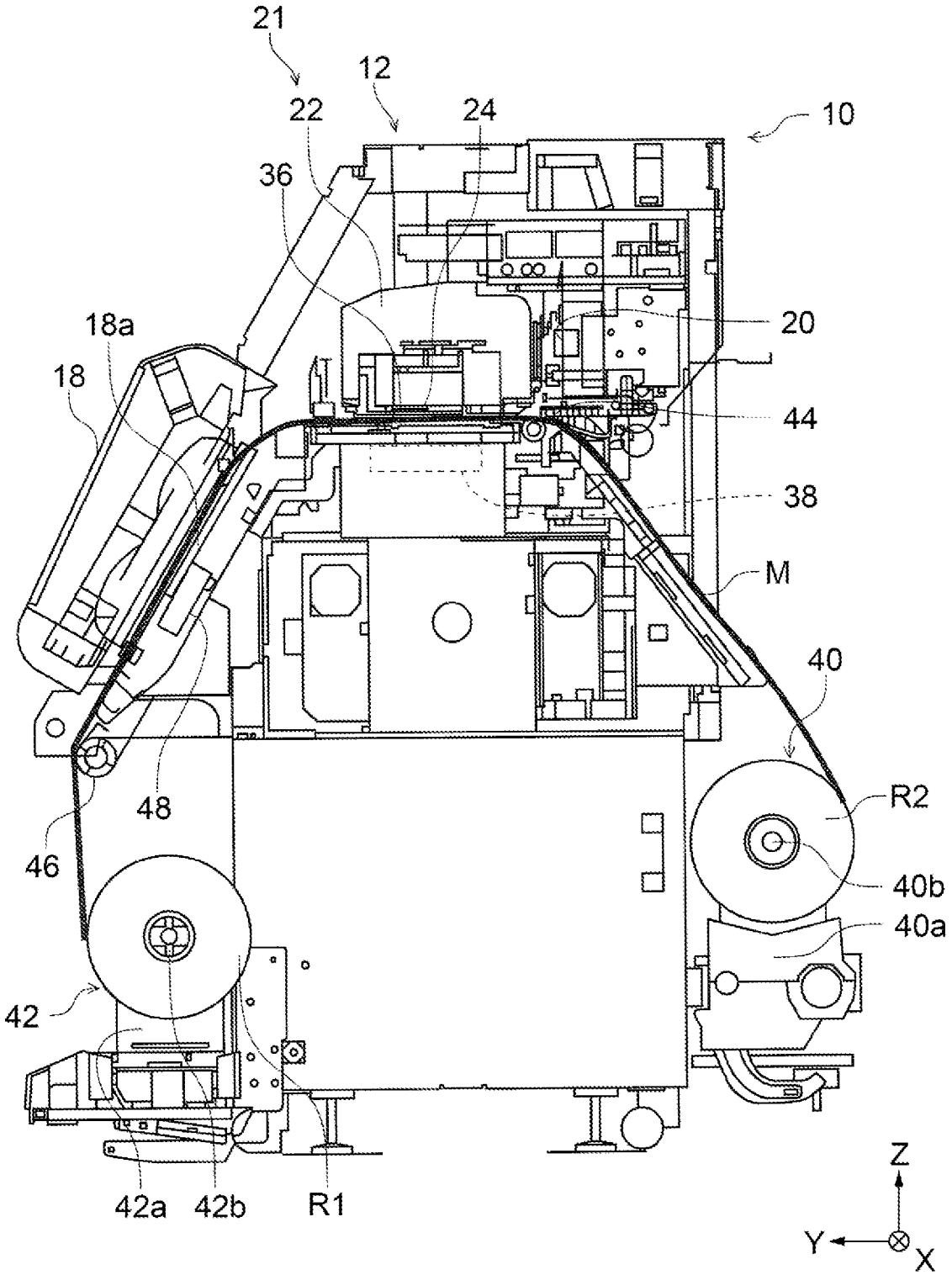
FIG. 3 is a cross-sectional schematic view illustrating a configuration of the printing apparatus.

As illustrated in FIG. 1 to FIG. 3, the printing apparatus 10 includes a main body 12 that is provided with a recording unit 21, and a pair of legs 14 that support the main body 12. The pair of legs 14 is provided on a lower portion of the main body 12, spaced apart in a direction along an X axis.

The main body 12 includes a housing 13 constituting an exterior wall and accommodates the recording unit 21 and the like. The housing 13 is formed in a cuboid shape. A drying unit 18 is provided on a +Y direction side of the main body 12. A main frame 20 extending in the direction along the X axis is provided on an upper portion of the main body 12. The recording unit 21 recording (printing) an image on the medium M is provided on the +Y direction side of the main frame 20. The recording unit 21 includes a carriage 22 and a recording head 24. The carriage 22 is installed on the main frame 20 so as to be capable of reciprocating in the direction along the X axis. The recording head 24 is disposed on a lower portion of the carriage 22. The recording head 24 includes a plurality of nozzles (not illustrated) capable of dispensing ink downward, as a liquid.

A plate-shaped suction platen 36 is provided opposite the recording head 24. The suction platen 36 extends in the direction along the X axis. The suction platen 36 is provided with a plurality of through holes running through in a direction along a Z axis. A suction fan 38 is installed below the suction platen 36. When the suction fan 38 is driven, air on an upper side of the suction platen 36 is sucked through the through holes in the suction platen 36. Thus a flow of air is formed from above to below the suction platen 36. As a result, in a state where the medium M is positioned on the suction platen 36, the medium M is suctioned to the suction platen 36 and is pressed against an upper face of the suction platen 36.

As illustrated in FIG. 3, a paper feed unit 40 is provided on a −Y direction side of the printing apparatus 10 and a paper discharge unit 42 is provided below the drying unit 18 on the +Y direction side. Note that depictions of the paper feed unit 40 and the paper discharge unit 42 are omitted from FIG. 1 and FIG. 2. In addition, the medium M is represented by a thick line in FIG. 3.

The paper discharge unit 42 includes a pair of bearings 42*a* and a spindle 42*b*. The pair of bearings 42*a* are configured to be movable in the direction along the X axis, which is the direction in which the pair of bearings 42*a* approach and separate from each other. The spindle 42*b* is inserted into an inner periphery of a discharge roll R1. Both end portions of the spindle 42*b* are supported by the pair of bearings 42*a*. Drive power is supplied to the bearings 42*a* by a drive source not illustrated in the drawings and the discharge roll R1 supported by the spindle 42*b* can be wound up, that is, configured such that front tension is applied to the discharge roll R1.

Similarly, the paper feed unit 40 also includes a pair of bearings 40*a* that are movable in the direction along the X axis and a spindle 40*b*. The spindle 40*b* is inserted into an inner periphery of a feed roll R2. Both end portions of the spindle 40*b* are supported by the pair of bearings 40*a*. Drive power is supplied to the bearings 40*a* by a drive source not illustrated in the drawings and the feed roll R2 supported by the spindle 40*b* can be fed out downstream in a transport direction. Given this, the bearings 40*a* control drawing of the medium M so that back tension is applied to the medium M that is drawn out of the feed roll R2.

The embodiment is configured such that the medium M is drawn out from the feed roll R2 of the paper feed unit 40, passes the suction platen 36 and the drying unit 18, and is wound up on the discharge roll R1 of the paper discharge unit 42.

A transport roller 44 is provided upstream of the suction platen 36 in the transport direction of the medium M. The transport roller 44 is configured as a driving roller driven by a drive source not illustrated in the drawings. The transport roller 44 is configured to be capable of rotating in both forward and reverse directions. In the embodiment, the forward direction is a direction in which the medium M that is wound on the feed roll R2 is drawn out and fed downstream in the transport direction, and the reverse direction is a direction in which the medium M is fed from downstream in the transport direction to an upstream side.

A discharge roller 46 is provided downstream of the drying unit 18. The discharge roller 46 is configured as a driving roller driven by a drive source not illustrated in the drawings.

The drying unit 18 includes a heater (not illustrated) as a heating source. The drying unit 18 heats the medium M that is on a path forming member 18*a*, causing moisture in the ink absorbed in the medium M to evaporate and promoting drying. A suction fan 48 is installed on a lower face side of the path forming member 18*a*.

A plurality of through holes (not illustrated) are formed in the path forming member 18*a* and when the suction fan 48 is driven, air on an upper side of the path forming member 18*a* is sucked through the through holes. Thus a flow of air is formed from above to below the path forming member 18*a*. As a result, in a state where the medium M is positioned on the path forming member 18*a* of the drying unit 18, the medium M is suctioned to the path forming member 18*a* and is pressed against an upper face of the path forming member 18*a*.

In addition, the printing apparatus 10 according to the embodiment is provided with a cover 100 configured such that an interior of the housing 13 is visible. The cover 100 is installed on a +Y direction end portion of the housing 13 and is configured to be open-and-closeable on the housing 13. FIG. 1 illustrates the cover 100 in a closed state while FIG. 2 illustrates the cover 100 in an open state. In the embodiment, a +X-direction upper end and a −X-direction upper end of the cover 100 are rotatably supported by a shaft 160 (see FIG. 4) installed in the housing 13 and extending in the direction along the X axis. Accordingly, in a state where fingers are placed on a handhold 115 (see FIG. 6) provided to a lower portion of the cover 100, by pulling out the cover 100 in the +Y direction, the cover 100 rotates about the shaft 160 and is opened. A damper 140 is provided coupling each of the +X-direction end and the −X-direction end of the cover 100 with the housing 13. The damper 140 may be configured in a gas spring form, for example. A high-pressure gas is sealed inside a cylinder of the damper 140 and the counterforce of the high-pressure gas is used as a spring. When the cover 100 is open, the damper 140 biases toward the cover 100. Thus, the cover 100 can maintain the open state.

Figure 4:
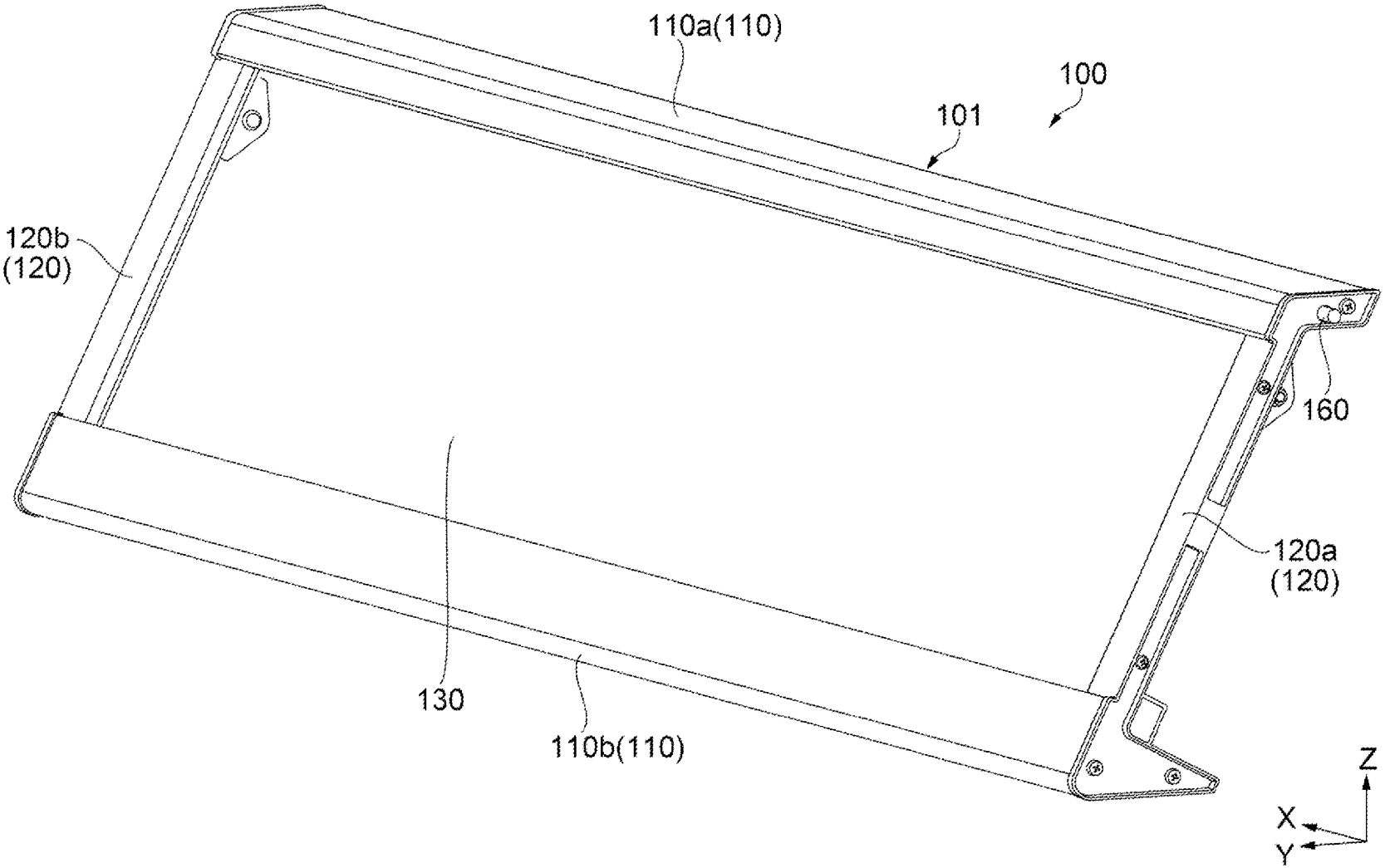
FIG. 4 is a perspective view illustrating a configuration of a cover.
Figure 5:
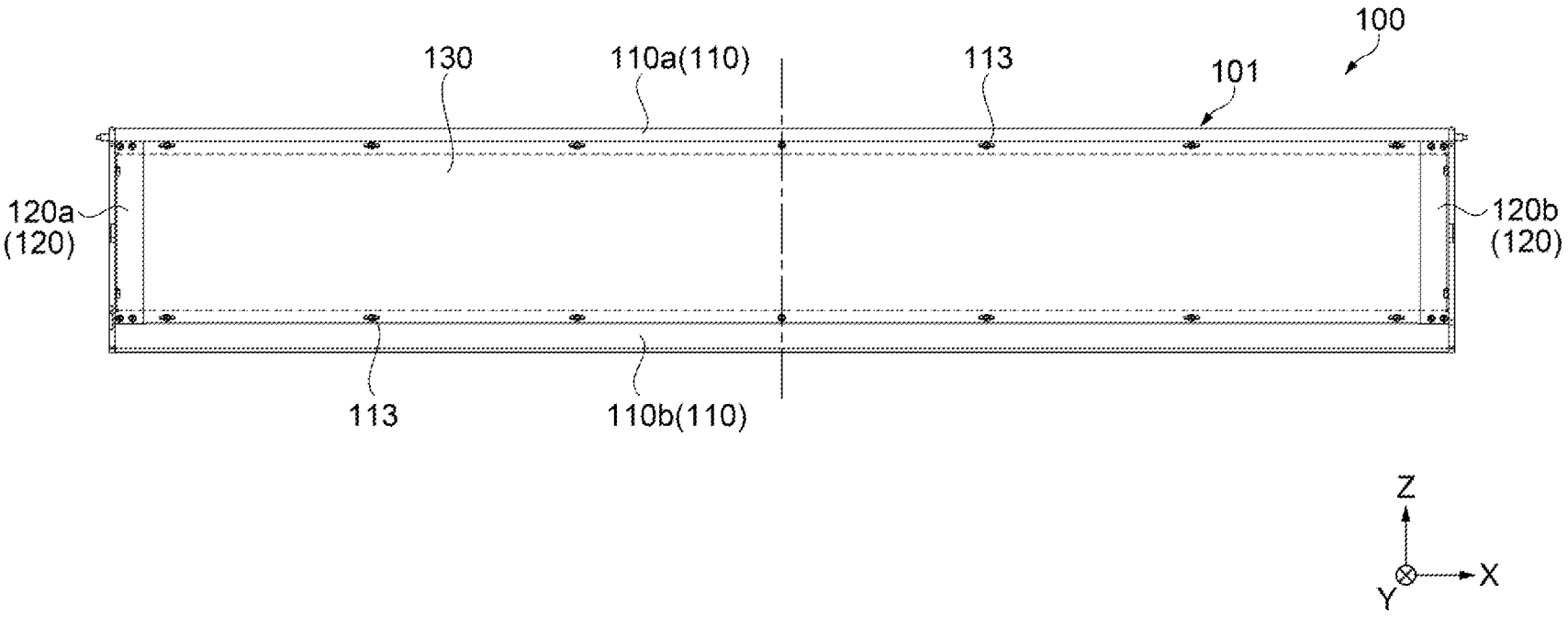
FIG. 5 is a plan view illustrating a configuration of the cover.

As illustrated in FIG. 4 and FIG. 5, the cover 100 includes a rectangular frame 101 having two long side parts 100 (110*a* and 110*b*) and two short side parts 120 (120*a* and 120*b*). The long side parts 110 and the short side parts 120 are fastened together with a screw, for example, to form the frame 101. A light transmissive plate 130 that is transmissive is installed in the frame 101. The light transmissive plate 130 is, for example, a plastic material. Accordingly, in a state where the cover 100 is closed, the interior of the housing 13 is visible through the light transmissive plate 130 and, for example, an operation status of the recording unit 21 can be verified. In addition, in a state where the cover 100 is open, the inside of the housing 13 is directly visible and, for example, a state of the image printed on the medium M can be verified.

Figure 6:
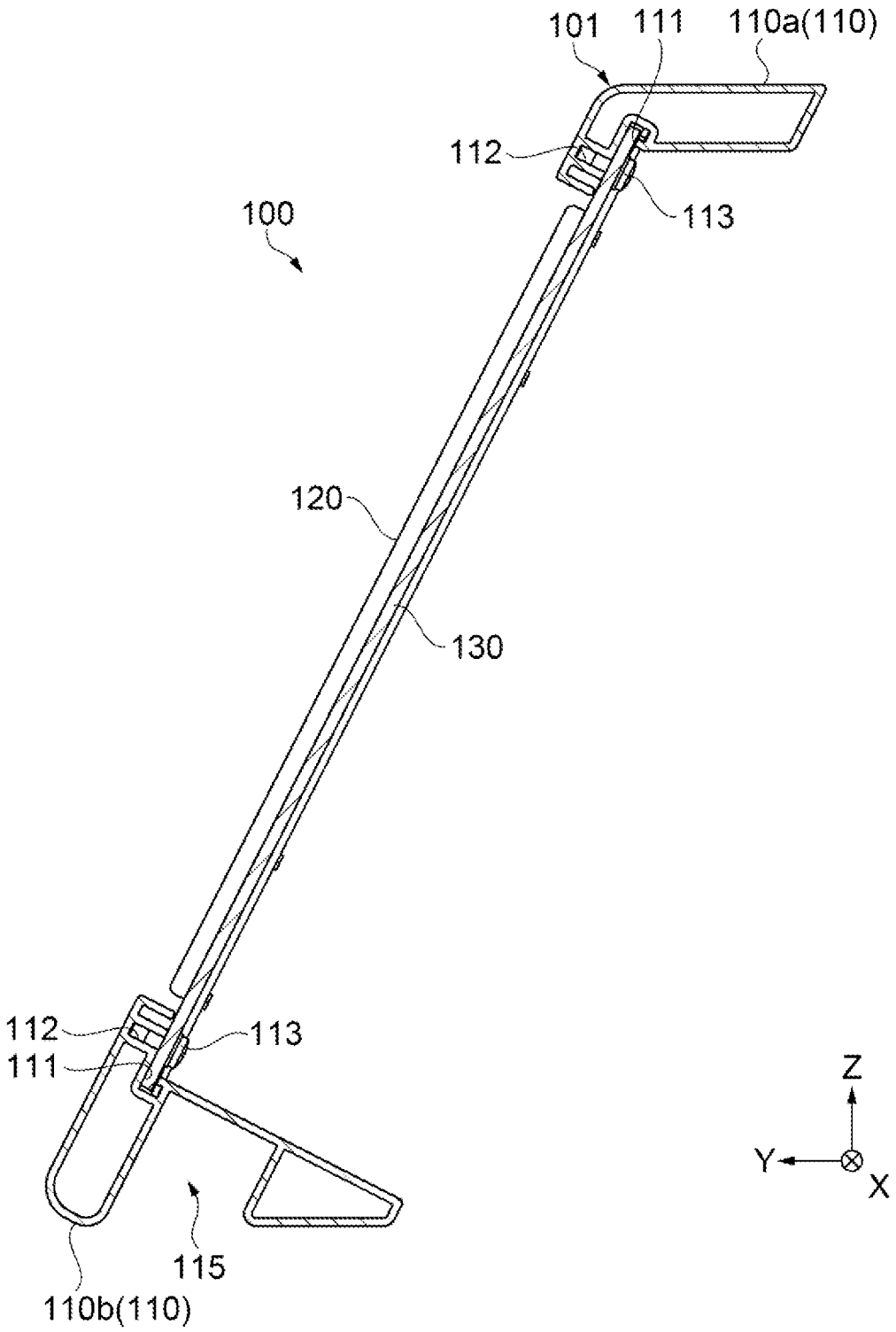
FIG. 6 is a cross-sectional view illustrating a configuration of the cover.

As illustrated in FIG. 6, the long side parts 110 of the cover 100 have a hollow structure that uses a metal material. The long side parts 110 use a metal material that has a lighter mass than the short side parts 120. Specifically, the long side parts 110 are composed of hollow aluminum member. The long side parts 110 are formed by extruding aluminum. In the frame 101, by configuring the long side part 110*a* that has a large length dimension as a hollow structure, the weight of the cover 100 can be reduced. Moreover, by increasing the surface area with the hollow structure, rigidity is maintained and therefore torsion of the cover 100 can be inhibited. Therefore, opening and closing the cover 100 can be performed smoothly. In addition, an impression of cheapness when opening and closing the cover 100 can be alleviated. Also, by using aluminum for the long side parts 110, the weight of the cover 100 can be further reduced. Note that the entire frame 101, including the short side parts 120, may also be composed of hollow aluminum member.

On the other hand, the short side parts 120 according to the embodiment are composed of a steel plate. Accordingly, the rigidity can be increased, and costs can also be curbed as compared to a case where the entire frame 101 is configured with hollow aluminum member.

As illustrated in FIG. 6, a groove 111 extending in a longitudinal direction (direction along the X axis) is provided to each of the long side parts 110*a* and 110*b*. The light transmissive plate 130 is fitted into the groove 111. The width dimension of the groove 111 is formed to be equal to the thickness dimension of the light transmissive plate 130. Accordingly, both surfaces of the light transmissive plate 130 are supported by the groove 111. Note that when installing the light transmissive plate 130 in the groove 111, if the width dimension of the groove 111 is increased to the point that the light transmissive plate 130 is loose, the light transmissive plate 130 may deform in a wave shape due to thermal expansion. In the embodiment, by supporting the entire end face of the light transmissive plate 130 with the groove 111, bending in the light transmissive plate 130 can be corrected. In addition, a screw groove 112 is provided to each of the long side parts 110*a* and 110*b* in a direction intersecting with a front surface of the light transmissive plate 130. Also, the light transmissive plate 130 is fastened to each of the long side parts 110*a* and 110*b* by a fastener 113 such as a screw via a plurality of through holes provided in the light transmissive plate 130.

Furthermore, in the embodiment, each end portion of a long side of the light transmissive plate 130 is supported by the respective long side part 110*a* or 110*b* of the frame 101, but each end portion of a short side of the light transmissive plate 130 is separated from the respective short side part 120*a* or 120*b* of the frame 101. In other words, a gap is provided between each short side of the light transmissive plate 130 and each of the short side parts 120*a* and 120*b*. Accordingly, when the light transmissive plate 130 stretches in a longitudinal direction due to thermal expansion, contact between the light transmissive plate 130 and the short side parts 120*a* and 120*b* can be prevented and deformation of the cover 100 can be inhibited. Note that when the cover 100 is closed, when the printing apparatus 10 is viewed in the −Y direction, the short side parts 120*a* and 120*b* are arranged so as to overhang above the short sides of the light transmissive plate 130. Therefore, viewed from the outside, the gap between each short side of the light transmissive plate 130 and each of the short side parts 120*a* and 120*b* cannot be seen. The light transmissive plate 130 is formed with a length-direction center as a reference. In addition, of the plurality of through holes provided to the light transmissive plate 130 in order to fasten the light transmissive plate 130 to the long side parts 110*a* and 110*b*, a through hole of the light transmissive plate 130 corresponding to the length-direction center is a round hole and other through holes are elongated holes, formed in consideration of thermal expansion of the light transmissive plate 130. As noted above, torsion of the cover 100 is inhibited, and therefore the embodiment can be configured with a single light transmissive plate 130. Accordingly, assembly man-hours and the like can be reduced.

In addition, as illustrated in FIG. 6, in the embodiment, of the long side parts 110*a* and 110*b*, the long side part 110*a* (one of the long side parts 110) located on the upper portion of the cover 100 is supported by the shaft 160 and the long side part 110*b* (other of the long side parts 110) located on the lower portion of the cover 100 is provided with the handhold 115. The handhold 115 is a recessed portion extending in the direction along the X axis of the long side part 110*b*. The cover 100 can be easily rotation-operated by placing fingers on the handhold 115. Note that the long side part 110*b* is formed with a greater volume than the long side part 110*a*. Accordingly, the handhold 115 can be formed to be comparatively large.

Figure 7:
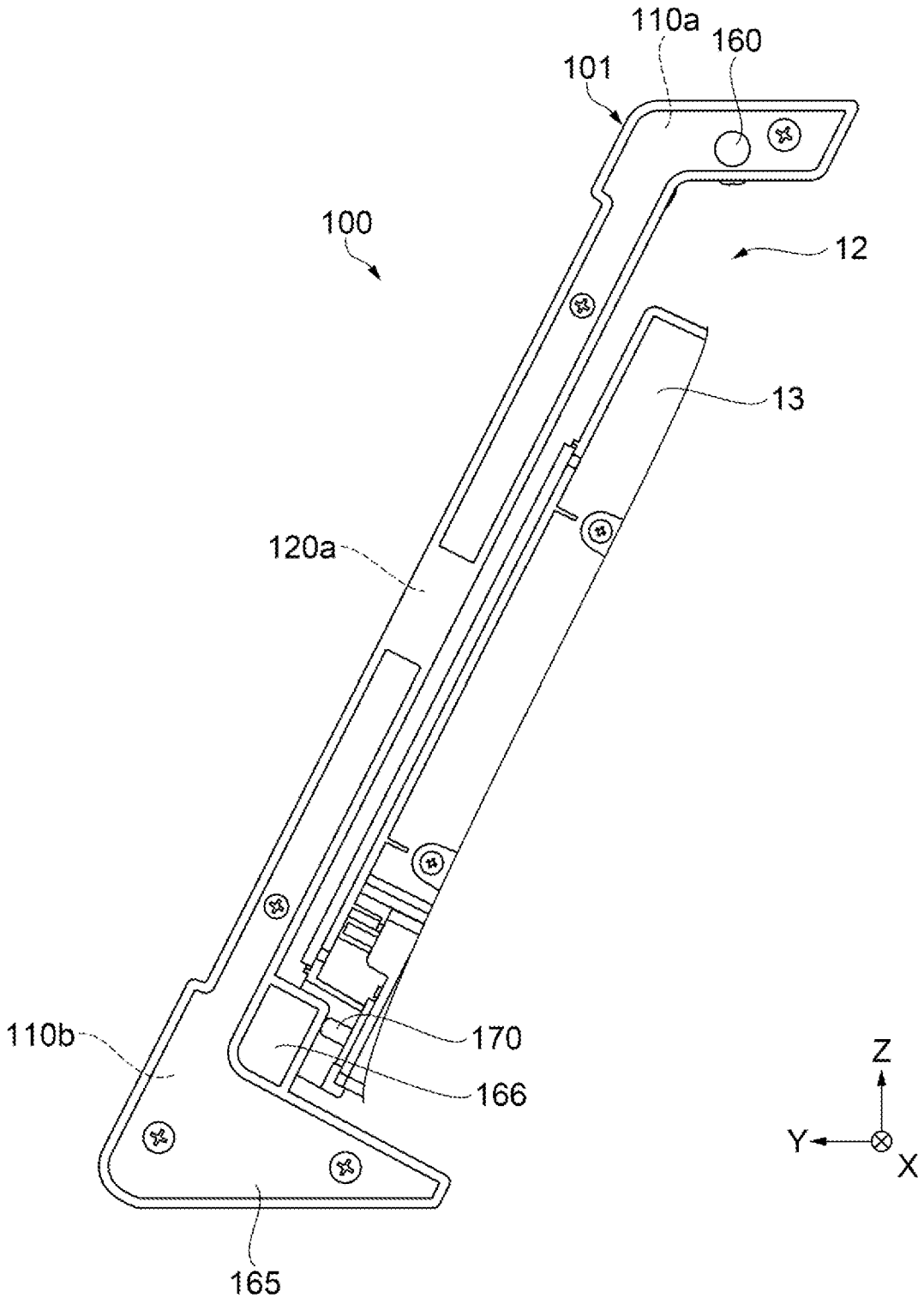
FIG. 7 is a side view illustrating a configuration of the cover.

As illustrated in FIG. 7, an interlock switch 170 is installed at a position corresponding to one end portion of the cover 100 of the main body 12 in the direction along the X axis. In the embodiment, the interlock switch 170 is disposed at a position corresponding to the −X-direction end portion of the cover 100 of the main body 12. A side wall portion 165 is installed on a side surface of the −X-direction end portion of the cover 100, and a plate-shaped flag portion 166 that can make contact with a tip portion of the interlock switch 170 is disposed on the side wall portion 165. The open/closed state of the cover 100 is detected by the interlock switch 170. In the embodiment, in order to inhibit torsion of the cover 100, the interlock switch 170 is provided at only one end portion of the cover 100 in the direction along the X axis. In other words, installing the interlock switch 170 at both ends of the cover 100 in the direction along the X axis may called for when there is a large amount of torsion in the cover 100, but in the embodiment, the interlock switch 170 may be installed at only one end and the structure of the printing apparatus 10 can be simplified.

What is claimed is:

1. A printing apparatus comprising:

a recording unit configured to record an image on a medium;

a housing configured to accommodate the recording unit; and a cover provided at the housing and configured to be opened and closed, the cover being configured such that an interior of the housing is visible; wherein the cover includes:

a rectangular frame having a first long side part, a second long side part, and two short side parts, a light transmissive plate that is transmissive and attached to the frame, each of the first long side part and the second long side part is a hollow structure with a metal material, a recessed portion is formed in the first long side part forming a handhold, the recessed portion being formed between a first projecting portion of the first long side part and a second projecting portion of the first long side part, the second projecting portion extending inwardly from the first projecting portion in a direction transverse to a direction in which the first projecting portion extends.

2. The printing apparatus according to claim 1, wherein each of the first long side part and the second long side part is composed of hollow aluminum member.

3. The printing apparatus according to claim 1, wherein each of the short side parts is composed of a steel plate.

4. The printing apparatus according to claim 1, wherein the light transmissive plate is supported by each of the first long side part and the second long side part and is separated from each of the short side parts.

5. The printing apparatus according to claim 1, wherein a groove is provided in a longitudinal direction of each of the first long side part and the second long side part and the light transmissive plate is fitted into the groove.

6. The printing apparatus according to claim 1, wherein the second long side part is supported by a shaft and the first long side part has a greater volume than the second long side part.

* * * * *